United States Patent [19]

Thompson et al.

[11] 3,976,286

[45] Aug. 24, 1976

[54] METALLURGICAL LANCES

[75] Inventors: Peter Thompson; John Richardson Taylor, both of Sheffield, England

[73] Assignee: GR-Stein Refractories Limited, Sheffield, England

[22] Filed: Aug. 19, 1974

[21] Appl. No.: 498,468

[30] Foreign Application Priority Data

Aug. 22, 1973 United Kingdom ..... 39696/73

[52] U.S. Cl. ..... 266/225; 29/195

[51] Int. Cl.[2] ..... C21C 7/00

[58] Field of Search ..... 29/195 M; 138/141, 143, 138/145, 147, 153, 174, 175; 106/58; 266/34 L, 34 LM, 34 T, 34 V, 225, 226

[56] References Cited

UNITED STATES PATENTS

| | | | |
|---|---|---|---|
| 3,071,458 | 1/1963 | Finkl | 266/34 T X |
| 3,352,552 | 11/1967 | Koenig et al. | 266/34 L |
| 3,430,940 | 3/1969 | Criss | 266/34 T |
| 3,833,209 | 9/1974 | Chang | 266/34 L |
| 3,839,057 | 10/1974 | Treffner | 106/58 |

FOREIGN PATENTS OR APPLICATIONS

| | | | |
|---|---|---|---|
| 801,519 | 9/1958 | United Kingdom | 266/34 V |

*Primary Examiner*—Roy Lake
*Assistant Examiner*—Paul A. Bell
*Attorney, Agent, or Firm*—Lowe, King, Price & Markva

[57] ABSTRACT

A lance for injecting fluid materials into molten metal comprising a length of metal tube having anchors secured to the outer surface of the tube and projecting from the tube, the anchors being spaced in the longitudinal and circumferential directions, and supplementary anchors suitably secured to the tube between the first anchors, there being applied over a major portion of the length of the tube a refractory coating, which refractory coating is held to the tube by the first anchors and the supplementary anchors.

6 Claims, 4 Drawing Figures

METALLURGICAL LANCES

Figures 1, 2, 3, 4:
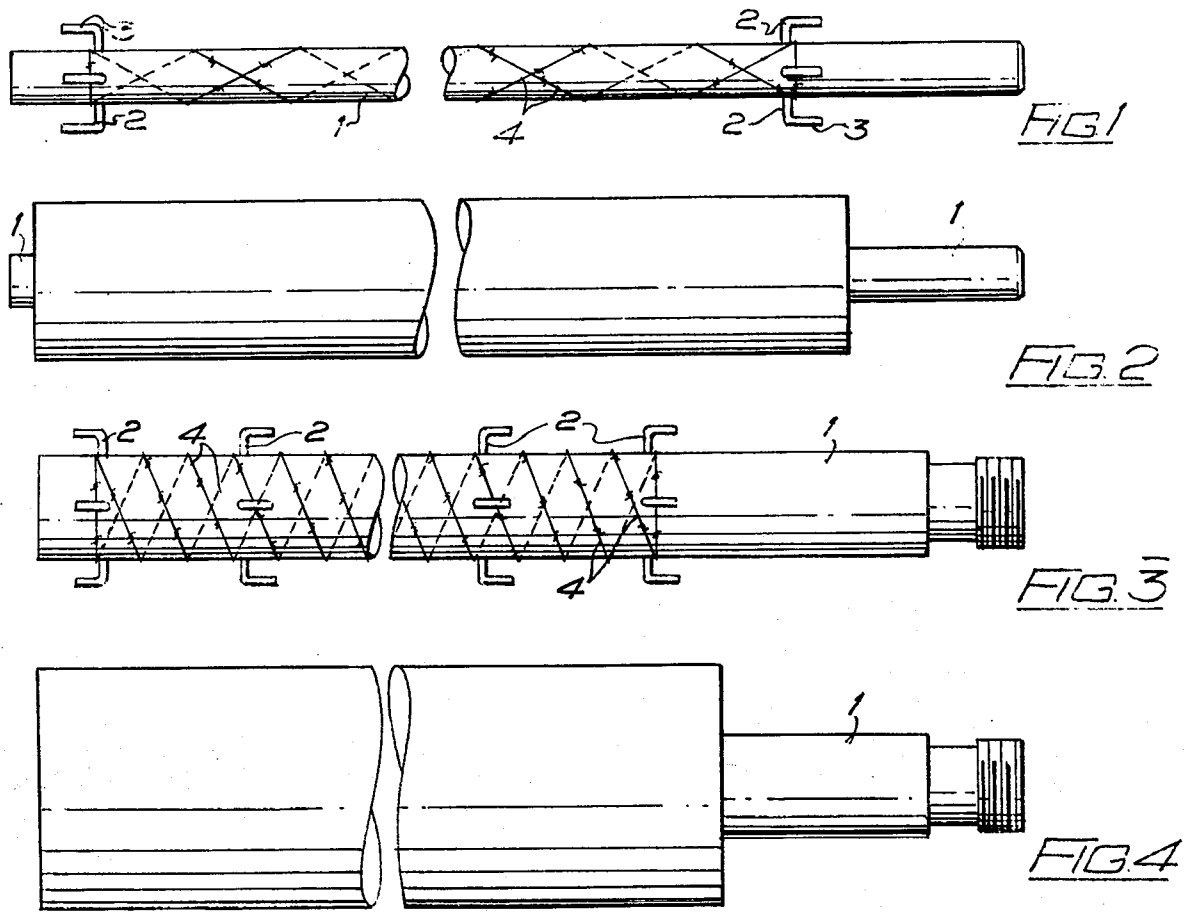

This invention relates to lances for the injection of materials into vessels containing molten metal.

In the treatment of molten metal it is necessary to introduce within the mass of molten metal materials capable of effecting certain chemical processes within the melt. Thus, e.g., in the process generally known as desulphurisation of hot iron in transfer ladles, a lance is usually connected to a source of nitrogen under pressure and to a supply of powdered calcium carbide, the gas and powder forming a fluidised system which is injected by the lance below the surface of the molten metal. Reaction occurs between the constituents of the metal and the reagent with the subsequent exchange of sulphur from the metal to the calcium slag that is formed.

The success of such injection methods, and for that matter other hot metallurgical injection processes, depends entirely on the availability of an economic lance capable of withstanding the process environment, where physical forces due to turbulence, vibration and pulsation combined with thermal stresses due to rapid heating and cooling, particularly the different thermal expansions that occur in the steel tubing that is normally used and the refractory coating that is generally provided, causes failure of the lance, this being in addition to the high temperature chemical erosion that inevitably takes place.

Thus, it is already known in an attempt to extend the life of lances to provide the steel tubing with a helical winding of wire to provide what is in effect a wire mesh wound on to steel tubing. A refractory coating is then applied to the tubing, the mesh acting as an anchor. However, it has been found in practice that a lance of this type cannot accept a refractory coating greater than 15 mm thick and with a coating of this thickness, it has again been found in practice that deterioration of the lance is rapid with the result that several lances have been found necessary to effect one desulphurisation process in large scale ladles containing approximately 220 tons of molten metal. Thus, shelling or separation of the refractory coating layers takes place along with both longitudinal cracking of the refractory coating and crazing of the refractory, this being in addition to the bloating or blistering that is consistent with gas evolution during the heating-up period of the lance. These factors coupled with an insufficient cooling mechanism during insertion and withdrawal of the lance combine to reduce lance life.

Experimentation has shown that with a lance of the type defined above, refractory thickness sufficient to give a high enough thermal differential between the inside and the outside of the refractory (i.e. more than 20 mm) for the refractory to assist the cooling derived from the fluid materials passing through the lance was difficult to apply to the steel tubing by conventional extrusion means with freedom from cracking and could not be retained in place on the steel tubing by the anchorage provided by the wire mesh.

According to the present invention, a lance for injecting fluid materials into molten metal comprises a length of metal tube having anchors secured to the outer surface of the tube and projecting from the tube, the anchors being spaced in the longitudinal and circumferential directions, and supplementary anchors suitably secured to the tube between the first anchors, there being applied over a major portion of the length of the tube a refractory coating, which refractory coating is held to the tube by the first anchors and the supplementary anchors.

The first anchors may be simply single studs of e.g., stainless steel, the free ends of which are bent to lie parallel to the tube, or they may be of the Y type, which can be split and suitably bent. These anchors may be positioned at each end of the tube, although it is possible to provide additional first anchors at relatively closely spaced intervals along the whole length of the tube.

It is preferred to utilise galvanised barbed wire for the supplementary anchors, which barbed wire is simply wound on to the tube such that the barbs lie between the permanent anchors. This latter construction leads to a greatly simplified production with a corresponding reduction in cost.

Whilst any technique for applying refractory material to the tube can be employed such as conventional moulding or even extrusion, it is preferred, according to a still further feature of the invention, to employ a vibration casting/pressing technique to ensure that the coating is free from cracking.

Therefore, according to the invention, a method of producing a lance of the type referred to above comprises securing main anchors at locations along the length and around the circumference of a metal tube, suitably securing supplementary anchors between the first anchors, locating the tube with its anchors in an open topped mould, supplying a suitable refractory material to the mould, vibrating the mould to compact the refractory material around the tube, subjecting the refractory material to a final pressing operation and finally drying the coating on the tube. Preferably, the supplementary anchors consist of galvanised barbed wire, single or double strength wrapped around the tube in helical configuration whereby the barbs on the barbed wire provide the supplementary anchors, In general, the vibration to which the mould is subjected is generally high, e.g., in the range 2500 to 3000 cycles/min. Whilst conventional drying can be employed, it is preferred to dry the coating from the inside to the outside to eliminate the formation of drying cracks. Thus, it is preferred to provide an insulated electrical resistance heating element along the inside of the tube, current passing along the heating element providing heat acting from the inside of the tube. The temperature cycle may be controlled by a thermocouple and temperature controller to provide the correct temperatures for not only drying but also the completion of any chemical bonding when the refractory applied to the tube is a chemically bonded refractory.

After heating, and before cooling of the tube, a refractory sealing compound may be applied to the surface of the refractory.

Two embodiments of the invention will now be described with reference to the accompanying drawings in which:

FIG. 1 is a side elevation of a tube provided with first anchors at each end of the tube and with supplementary anchors formed by galvanised barbed wire;

FIG. 2 corresponds to FIG. 1 but shows a lance complete with its refractory coating;

FIG. 3 corresponds to FIG. 1 but shows a tube with main anchors at closely spaced intervals along its length and with supplementary anchors formed by galvanised barbed wire; and, FIG. 4 corresponds to FIG. 3 but shows the lance complete with its refractory coating.

In FIG. 1 a hot drawn seamless steel tube 1 is provided with anchors 2 formed by studs of stainless steel, the free ends 3 of which are bent to lie parallel to the tubes, the stud being spaced circumferentially around the tube and spaced in the longitudinal direction by the length of the tube. Supplementary anchors 4 are provided on the tube in the form of the application of galvanised barbed wire secured at each end of the tube to the anchors 2 and wound on to the tube in the form of a double helical winding with the second winding of opposite pitch to the first. The tube complete with its main and supplementary anchors is then applied to an open topped mould (not shown) to which is supplied a suitable refractory material such as 85% alumina with a chemical bonding agent such as aluminium phosphate or phosphoric acid or possibly a 60% alumina refractory, again with a phosphate bond, when the lance is intended for use with iron, or again an 85% alumina phosphate bonded refractory or a calcium polyphosphate bonded magnesite refractory when the lance is intended for use with steel. The mould is then vibrated in the range 2500 to 3000 cycles/min., and the refractory coating thereby provided on the lance then being dried from the inside to the outside to avoid the formation of drying cracks e.g., by inserting an insulated electrical resistance heating element along the inside of the tube and passing current along the heating element. The tube of FIG. 1 is shown in FIG. 2 complete with its refractory coating.

In the alternative construction shown in FIG. 3, in addition to the anchors 2 at each end of the tube further anchors 2 (again in the form of studs of stainless steel) are provided in a relatively closely spaced relationship along the length of the tube and circumferentially. The supplementary anchors 4 are again provided by the application of galvanised barbed wire but in this embodiment instead of the barbed wire being wrapped in a double helical configuration the barbed wire is first wrapped in a helical manner in one direction along the tube, secured to the anchors at the far end of the tube and then re-wound back along the tube in helical manner with the pitch of the helices the same as the first winding. The refractory coating is provided on the tube in the manner described in relation to FIG. 1 and the tube provided with the coating is shown in FIG. 4.

To determine the effectiveness of the lances of the invention they were employed in the so-called burnt lime/propane desulphurising process and in the carbide desulphurising processes in ladles of hot iron having a capacity of 240 tons. In contrast to conventional lances, lances in accordance with the invention succeeded in achieving an average of 12 separate desulphurising processes, and in some instances up to 16 separate desulphurising processes.

What we claim is:

1. A lance for injecting fluidized particulate material into molten metal, comprising a metal tube having first anchor means secured to the outer surface of the tube and projecting outwardly from the tube, said first anchor means being secured to the tube at least adjacent the ends of the tube and spaced circumferentially around the tube, and supplementary anchor means formed of wire secured to the tube and extending substantially between said first anchor means, a plurality of barbs spaced along said wire projecting outwardly from said tube, a refractory coating applied over a major portion of the length of the tube and covering said first and supplementary anchor means, whereby the refractory coating is held to the tube by the said first anchor means and by said wire and said barbs.

2. A lance as in claim 1, wherein a diamond shaped network grid of supplementary anchor means is formed by the wire and barbs helically wound around the circumference and along the length of the tube.

3. A lance as in claim 1, wherein the refractory coating on the tube comprises a chemically bonded alumina refractory.

4. A lance as in claim 1, wherein the refractory coating on the tube comprises a chemically bonded magnesite refractory.

5. A lance as in claim 3, wherein the chemical bond comprises a phosphate bond.

6. A lance as in claim 4, wherein the bond comprises calcium polyphosphate.

* * * * *